United States Patent [19]

Varley

[11] Patent Number: 4,715,606

[45] Date of Patent: Dec. 29, 1987

[54] GOLF CLUB WITH HEAD WEIGHT CONTROL DEVICE

[76] Inventor: Alan Varley, Kowitzberg 41, 2407 Lübeck-Travemünde, Fed. Rep. of Germany

[21] Appl. No.: 803,121

[22] Filed: Nov. 29, 1985

[30] Foreign Application Priority Data

Dec. 3, 1984 [DE] Fed. Rep. of Germany ..... 3444072

[51] Int. Cl.[4] ..... A63B 69/36

[52] U.S. Cl. ..... 273/194 B; 273/170; 273/171

[58] Field of Search ..... 273/167 H, 170, 193 R, 273/194 R, 171, 167 F, 167 K, 168, 169, 194 A, 194 B, 186 A

[56] References Cited

U.S. PATENT DOCUMENTS

| | | | |
|---|---|---|---|
| 1,561,595 | 11/1925 | Davis | 273/170 |
| 1,568,888 | 1/1926 | Dunn | 273/167 H |
| 2,432,450 | 12/1947 | Sears | 273/171 |

*Primary Examiner*—George J. Marlo

*Attorney, Agent, or Firm*—Thomas R. Morrison

[57] ABSTRACT

The invention concerns a golf club which finds use particularly as training device. For the purpose of the adaptation of the device to the individual needs of the player, for example in respect of build-up or improvement in the condition, the shaft of the device is at least partially filled with a flowable filling material which, with the effect of the redisposition of the center of gravity while the total weight remains constant, can be redisposed in desired partial quantity into the hollow space of the striker head by way of an openable closure arranged in the region of that end of the shaft, which faces the striker head.

5 Claims, 5 Drawing Figures

GOLF CLUB WITH HEAD WEIGHT CONTROL DEVICE

Figure 1:
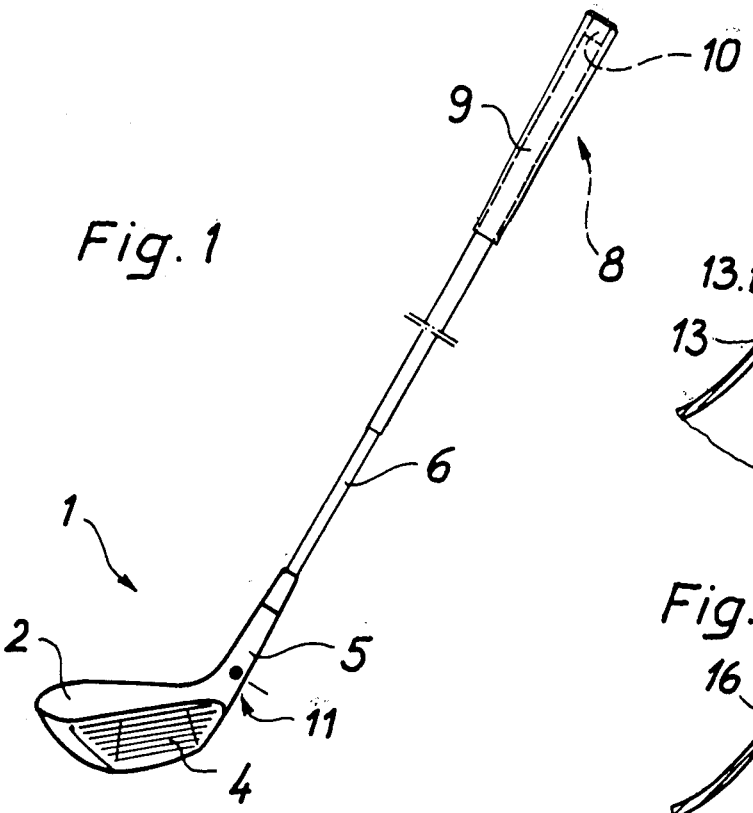

The invention concerns a golf club suitable for competition and training purposes and consisting of a striker head constructed as hollow body and having a striking surface and a shaft holder arranged laterally therebesides and displaying a bore opening into the hollow space of the club head, as well as of a shaft which is constructed as hollow profile, is fastenable by its one end in the shaft holder, displays a detachable closure in the region of its free end and is provided with a grip part for the holding and guiding of the device.

Golf clubs of the mode of construction corresponding to the invention in reference are in trade as standard competition devices, for which the hollow space usually disposed in the striker head is filled by means of a setting synthetic material foam mass in order to damp the impact noise and/or to let it come to appear to be lower in frequency.

In the case of a golf club suitable particularly for training purposes, it matters that the "golf muscles" are strengthened more rapidly, the condition is improved or retained and the impact course is practised for the purpose of attainment of high precision through becoming familiar with such a device. The training person for this purpose desires a device which is settable in simple mode and manner and in that case exactly and in correspondence with his repsective needs. These needs comprise a wide tolerance field and are in particular influenced by person factors, such as for example state of training, condition, endeavour to advance and similar. The parameters, which determine the "character" of a golf club most lastingly, are its weight as well as the weight distribution, i.e. the position of its centre of gravity. In that case, the last named parameter is the one, the manipulation of which has the most substantial effects, since the position of the centre of gravity is decisive on the one hand for the acceleration work to be exerted by the player and on the other hand for the momentum of the strike.

Different methods are known for influencing these parameters.

Thus, it is known to regulate the centre of gravity of a golf club thereby, that a limited hollow space, which is left in the mentioned synthetic material filling and is accessible from the base plate of the striker head through taking-out of a closure screw, is for example fillable with lead powder. Even when the possibility exists of performing such a manipulation repeatedly, a single setting of the device to the properties, which are internationally defined uniformly under the designations C0, C1, C2 . . . to D10, is however as a rule undertaken by this action. For an extensive utilisation of this possibility, it is disadvantageous that the weight of the device is altered at the same time.

It is furthermore known from the practised state of the art to vary the "character" of a golf club through the mounting of external weights. Such a method represents no satisfactory solution, since this manner of procedure is most uneconomical. This becomes particularly clear when one considers that each weight addition of 2 grams in the region of the striker head corresponds to one step of the named scale. Apart from the fact that this method requires the keeping of a multiplicity of such weights or the integral multiple thereof in readiness, high demands have to be met in the security of the respective fastening which must be equal to the arising high impact and centrifugal forces. If, in addition, the weight of the golf club is to be increased for example while maintaining the position of the centre of gravity, then it is required to arrange equal weights to both sides of the centre of gravity.

In the DE-OS No. 23 37 985, a golf club is described, which for the purpose of the re-inforcement of the momentum of the strike is provided with a striker head which displays at least one closable bore, which starts out from the side lying opposite the striking surface and runs towards the striking surface and in which at least one ball is arranged, which is freely movable in axial direction. Since the momentum of the strike results from the speed of impact on coming into contact with the ball and from the mass inertia determining the momentum mass of the device, the mass of the balls indeed contributes to an increase in this mass inertia, but their effect occurs with delay relative to that of the striker head so that the assumed total effect stands in question. For the remainder, the named disadvantages here appear in combination.

Finally, a golf club of the "putter type" is known from the U.S. Pat. No. 2 432 450, the shaft and striker head of which display hollow chambers which stand in communication one with the other, are filled with mercury and bounded by displaceable pistons. In that case, the piston disposed in the striker head is spring-loaded and that disposed in the shaft operatively connected with the end closure of the same in such a manner that a rotation of the end closure effects a reduction or enlargement of the volume of the hollow chamber of the shaft. It is possible in this manner to displace mercury into the hollow chamber of the striker head and thereby to vary the position of the centre of gravity of the device within small limits.

Transfer of the system to golf clubs of the present intention is prohibited particularly by reason of the substantially higher loading acting on these and the danger resulting therefrom of a damage which can have the consequence of a release of the toxic effect of the mercury filling. Beyond that, the limits of the influence on the weight of the device and the position of its centre of gravity are too narrow for the envisaged intention of the device.

It is the task of the invention to offer a golf club, the total weight of which can be set in wide limits of individual needs. Moreover, it shall be possible in simple manner equally well to influence the position of the centre of gravity merely with the use of means integrated into the golf club, for which also extreme striker head weights, for example F10 and higher, shall be attainable. Finally, standard golf clubs shall be preparable by slide action in the sense according to the invention.

This problem is solved according to the invention thereby, that in the region of the end, which points to the striker head, of the shaft, there is provided a detachable closure blocking off the hollow cross-section thereof.

The advantages attainable thereby consist particularly in that a connection of the hollow spaces disposed in the shaft and in the striker head are produced through detaching of the closure. It is possible in this manner to attain a partial or complete filling of the striker head through allowing the filling material to flow over and thereby attain a displacement of the centre of gravity without the total weight, produced by the shaft filling, of the device being altered. By the determination of the degree of the filling of the striker head, the possibility is thus given of setting the inertia mass each time to the amount tolerable to the training person without in that case altering the weight providing the feeling for the motional course to the player. Equally well, the total weight may be set individually through suitable choice of the filling material and/or the filling quantity.

According to a preferred embodiment, it is provided, that that end of the shaft, which is disposed in the shaft holder of the striker head, is closed off at its end face and that in the proximity of the same, there is associated a closure screw, which passes through the shaft holder together with the shaft substantially in its plane of symmetry and transversely to its longitudinal axis, as closure. This achieves on the one hand a secure separation of the hollow spaces of shaft and striker head and on the other hand secure connection after the detaching of the closure without the danger of the falling-out of the closure screw existing.

According to a further embodiment, the closure comprises a plug inserted into the hollow cross-section of the shaft and having an axial bore which is interrupted by a threaded bore crossing the same and introduced from the outside of the shaft holder for the reception of a closure screw provided with a transverse bore.

The invention is explained more closely in the following by reference to the drawing. There show FIG. 1 an overall view of a standard golf club in axonometric illustration with the shaft illustrated shortened, FIG. 2 a cross-section through the golf club, according to the invention, with the shaft illustrated shortened and with the closure in a closed position FIG. 3 a cross section through the golf club similar to FIG. 2 with the closure in an open position.

Figure 4:
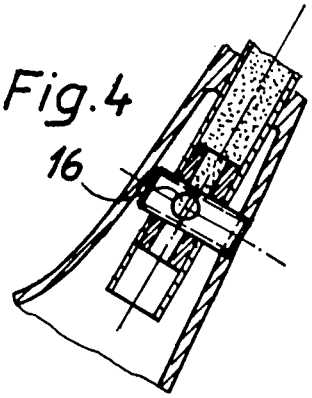

FIG. 4 a partial cross-section in the region of the shaft holder with a second embodiment of a closure in a closed position.

Figure 5:
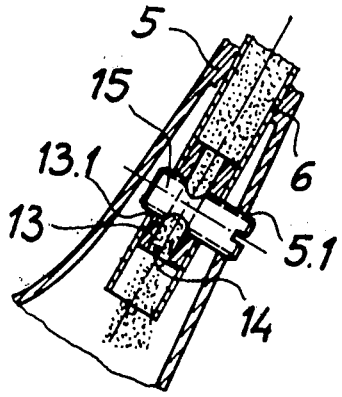

FIG. 5 a partial cross section similar to FIG. 4 with the closure in an open position.

A standard golf club 1, which is suitable for the equipment according to the invention, according to FIG. 1 consists of a striker head 2, constructed as a hollow body, with a striking surface 4 and a shaft holder 5, which is arranged laterally besides this and displays a bore opening into the hollow space 3 of the striker head 2. A shaft 6, consisting of a thin-walled tube, is inserted by its one end 7 into the shaft holder 5 and connected therewith, usually by gluing. The free end 8 of the shaft 6 terminates by a grip part 9 for the holding and guiding of the device by the player. This free end 8 is closable in suitable manner by means of a detachable closure 10, for example a threaded plug.

Figure 3:
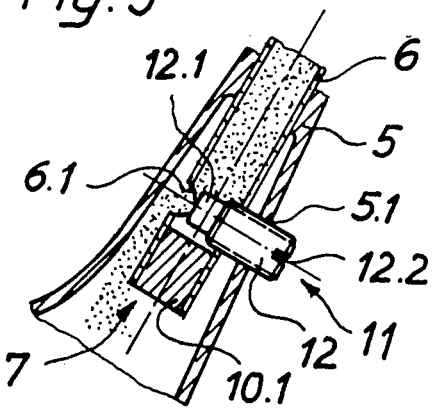
Figure 2:
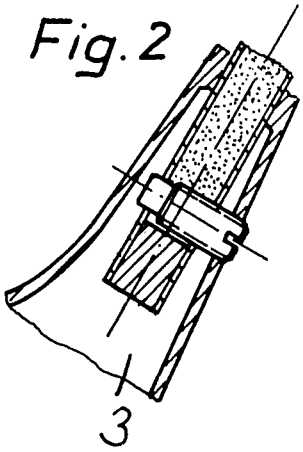

Referring now to FIGS. 2 and 3, a closure is shown generally at 11. The end 7 of the shaft 6 within the shaft holder 5 is securely closed by a plug 10.1. A cylindrical bore-hole 6.1 passing completely through shaft 6 is aligned with a second cylindrical bore-hole 5.1 passing through one wall of shaft holder 5. Cylindrical bore 5.1, and preferably also the part of cylindrical bore 6.1 adjacent thereto are threaded for receiving a threaded closure screw 12. A stopper or spigot 12 at an inner end of closure screw 12 is sized for sealable entry into the adjacent part of cylindrical bore 6.1. The sealing position of closure screw 12 is shwon in FIG. 2, its open position is shown in FIG. 3. A slot 12.2 enables rotation of closure screw for adjustment between the open and closed positions.

Referring now to FIGS. 4 and 5, a further embodiment of the invention is shown. A plug 13 in shaft 6 includes an axial bore therein. A threaded bore 13.1 passes transversely through shaft 6 and plug 13. A cylindrical bore 5.1 is disposed in shaft holder 5 in alignment with cylindrical bore 13.1. A closure screw 15 in threaded bore 13.1 includes a transverse bore 16 (FIG. 4) therein. The closure screw 15 may be rotated into the open position shown in FIG. 5 wherein the transverse bore 16 is aligned with the axial bore 14 to permit communication between the shaft 6 and the interior of the hollow space 3 within the club head 2. Alternately, the closure screw 15 may be rotated into the closed position shown in FIG. 4 wherein the transverse bore is out of alignment with the axial bore 14 and thus the closure screw blocks communication between the shaft 6 and the hollow space 3.

The golf club prepared in this manner now represents a device, the use of which by reason of the additional weight makes increased demands on muscles and condition. For further increase in these demands, a communication between the hollow space of the shaft 6 filled with the filling material 17 and the hollow space 3 in the striker head 2, so that filling material can overflow into the latter, can now be produced through loosening of the closure screw 12 or 15. In this manner, the centre of gravity of the device redisposes towards the striker head 2, which in spite of unchanged total weight demands a higher acceleration work from the player. By the regulation of the quantity of filling material redisposed into the striker head 2, the degree of the loading lets itself be adapted on the spot at any time in accordance with the individual wishes.

On the use of suitable filling material, it is possible by the preparation according to the invention to set one and the same golf club to practically every stage of the property featuers C0, C1 . . . to D10 and beyond that.

I claim:

1. A golf club comprising:
- a head;
- a hollow space within said head;
- a shaft holder having a bore therein communicating with said hollow space;
- a hollow shaft having an inner end affixed to said shaft holder;
- means for permitting addition of a flowable filling material into said shaft; and
- control means adjacent said inner end of said shaft, adjustable from outside said golf club for controlling a free flow of said flowable filling material between said hollow shaft and said hollow space, whereby a weight distribution of said golf club is adjusted.

2. A golf club according to claim 1 wherein said means for permitting addition of a filling material includes a plug sealable in a free end of said hollow shaft.

3. A golf club according to claim 1 wherein said control means includes:
- a bore passing through said hollow shaft and an aligned bore in said shaft holder;
- a closure member in said bore; and
- cooperating means in said closure member and said hollow shaft for controlling said free flow of said flowable filling material from said hollow shaft into said hollow space.

4. A golf club according to claim 3 wherein said cooperating means includes:

an axial bore in said hollow shaft;

said closure member being a screw passing transversely through said hollow shaft;

a transverse bore in said screw; and said transverse bore being alignable with said axial bore for permitting said filling material to pass therethrough and being further rotatable out of alignment with said axial bore for preventing said filling material to move therepast.

5. A golf club according to claim 3 wherein said cooperating means includes:

a plug sealing an end of said hollow shaft within said shaft holder;

a transverse bore through said hollow shaft above said plug;

an aligned bore in said shaft holder aligned with said transverse bore;

a closure screw in said transverse bore;

means for permitting partial withdrawal of said closure screw from said transverse bore whereby at least part of said transverse bore is opened for permitting said filling material to pass from said hollow shaft to said hollow space.

* * * * *